US009297542B2

(12) United States Patent
Uehara et al.

(10) Patent No.: US 9,297,542 B2
(45) Date of Patent: Mar. 29, 2016

(54) WALL-MOUNTED TYPE AIR CONDITIONER

(75) Inventors: Yuhji Uehara, Osaka (JP); Akihiro Itani, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 995 days.

(21) Appl. No.: 13/389,421

(22) PCT Filed: Jun. 28, 2010

(86) PCT No.: PCT/JP2010/060949

§ 371 (c)(1),
(2), (4) Date: Feb. 7, 2012

(87) PCT Pub. No.: WO2011/021440

PCT Pub. Date: Feb. 24, 2011

(65) Prior Publication Data

US 2012/0135674 A1 May 31, 2012

(30) Foreign Application Priority Data

Aug. 19, 2009 (JP) ..... 2009-189819

(51) Int. Cl.

| | |
|---|---|
| ***F24F 7/06*** | (2006.01) |
| ***A23L 3/36*** | (2006.01) |
| ***F24F 1/00*** | (2011.01) |
| ***F24F 13/20*** | (2006.01) |

(52) U.S. Cl.

CPC ..... *F24F 1/0007* (2013.01); *F24F 1/0011* (2013.01); *F24F 1/0025* (2013.01); *F24F 13/20* (2013.01); *F24F 2001/0048* (2013.01); *F24F 2221/22* (2013.01)

(58) Field of Classification Search

USPC ..... 454/338, 251; 62/303
IPC ..... F24F 1/0007,13/20, 1/0011, 11/00, F24F 1/0025, 2221/22, 2001/0048
See application file for complete search history.

(56) References Cited

FOREIGN PATENT DOCUMENTS

| | | | |
|---|---|---|---|
| JP | 58-172717 U | | 11/1983 |
| JP | 07-260246 | * | 10/1995 |
| JP | 7-260246 A | | 10/1995 |
| JP | 8-135994 A | | 5/1996 |
| JP | 8135994 | * | 5/1996 |
| JP | 9-273769 A | | 10/1997 |
| JP | 10-137698 A | | 5/1998 |
| JP | 2001-41493 A | | 2/2001 |
| JP | 2001-221497 A | | 8/2001 |
| JP | 2004-20151 A | | 1/2004 |
| JP | 2004-190991 A | | 7/2004 |

* cited by examiner

*Primary Examiner* — Steven B McAllister
*Assistant Examiner* — Helena Kosanovic
(74) *Attorney, Agent, or Firm* — Birch, Stewart, Kolasch & Birch, LLP

(57) ABSTRACT

A wall-mounted type air conditioner allows attachment and detachment of a fan without depending on a shape of a heat exchanger and without moving the heat exchanger. The air conditioner includes: a main body housing a fan; and a drain pan assembly. The drain pan assembly has: a peripheral part forming an outlet port to expel air from the fan; and a drain pan and is detachably attached to the main body. The main body includes, an opening part for withdrawing the fan. The drain pan assembly is attached to the main body with the outlet port facing the opening part. The outlet port peripheral part includes: an upper wall part located above the outlet port; and another outlet port.

4 Claims, 15 Drawing Sheets

WALL-MOUNTED TYPE AIR CONDITIONER

TECHNICAL FIELD

The present invention relates generally to air conditioners and, in particular, to a wall-mounted type air conditioner.

BACKGROUND ART

Inside a main body of an indoor apparatus of an air conditioner, a heat exchanger, a fan, and the like are housed. Water drops and dust easily attach to the fan. If the water drops and dust attaching to the fan are left as they are, mold may grow and be scattered in a room targeted for air conditioning together with air sent out into the room targeted for air conditioning by the fan from the indoor apparatus. In addition, if the water drops and dust attaching to the fan are left as they are, an unpleasant odor may be caused.

Therefore, conventionally, the whole of the indoor apparatus mounted on a wall surface of the room targeted for air conditioning is detached from the wall surface and disassembled, and the fan is cleaned.

However, in a case where the fan is cleaned in the above-mentioned manner, it is required to detach the indoor apparatus, mounted on the wall surface, from the wall surface, to disassemble the indoor apparatus, to draw out and clean the fan, to reassemble the indoor apparatus to be in the original state, and to mount the indoor apparatus on the wall. At the heat exchanger housed in the indoor apparatus, a pipe for circulating a refrigerant is fixed. This pipe extends from the indoor apparatus to an outdoor apparatus and is fixed both at the heat exchanger of the indoor apparatus and a heat exchanger of the outdoor apparatus. Therefore, it is difficult to detach from the wall surface the indoor apparatus in which the heat exchanger is housed and to attach the indoor apparatus again on the wall surface after finishing the cleaning.

On the other hand, for example, Japanese Patent Application Laid-Open Publication No. 8-5994 (Patent Literature 1) discloses an air conditioner which allows a fan to be detached from the air conditioner while the air conditioner remains mounted on a wall. In this air conditioner, one end of a rotation axis of the fan is supported by a fan motor and the other end thereof is supported by a bearing provided, with the fan interposed therebetween, on a side wall on a side opposed to a side on which the fan motor is located. A distance with which the fan motor and the fan are fitted is smaller than a distance of a clearance between the fan and the side wall. When the fan is detached, fixation screws are first loosened, the fan is thereafter slid in a direction toward a side of the side wall, and the rotation axis and the fan motor of the fan are disengaged. Next, a side of the heat exchanger on the side of the side wall is slightly lifted up, and the fan is drawn out together with the bearing from a clearance between the heat exchanger and the air conditioner main body. In the above-mentioned manner, while the fan motor and an electric component box remain mounted in the air conditioner main body, only the fan can be drawn out, with the air conditioner main body being installed on the wall.

In addition, Japanese Patent Application Laid-Open Publication No. 10-137698 (Patent Literature 2) discloses an indoor apparatus of an air conditioner whose heat exchanger is formed to have a given shape or to be in a given state so as to avoid collision of a fan with a housing and the heat exchanger, occurring when the fan is attached to and detached from the indoor apparatus of the air conditioner, and so as to allow easy attachment and detachment of the fan. In this indoor apparatus, the heat exchanger is formed to be, for example, plate-like and is located so as to cause a long side thereof to be horizontal and a short side to be vertical. In addition, for example, a lower portion of the heat exchanger is curved. In addition, components in front of an attachment and detachment doorway through which the fan passes when attached to and detached from the indoor apparatus, namely, a front panel, a dew drip tray, a louver located in front of an blow-out port, and the like are detached. As described above, the components in front of the attachment and detachment doorway are detached and the shape of the heat exchanger is contrived, thereby allowing the fan to be attached and detached without moving the heat exchanger.

In addition, in Japanese Patent Application Laid-Open Publication No. 9-273769 (Patent Literature 3), described is a ceiling-mounted cassette type air conditioner in which an blow-out side of a fan casing is divided into a frame main body on a side of an heat exchanger and a blow-out port part detachably attached to the frame main body, with a boundary being a shaft center of a fan, and supporting of the fan is released by detaching the blow-out port part. In this ceiling-mounted cassette type air conditioner, a side plate of a lower end portion of the fan casing is integrated with a blow-out port frame and can be detached from the fan casing.

CITATION LIST

Patent Literature

Patent Literature 1: Japanese Patent Application Laid-Open Publication No. 8.135994

Patent Literature 2: Japanese Patent Application Laid-Open Publication No. 10-137698

Patent Literature 3: Japanese Patent Application Laid-Open Publication No. 9-273769

SUMMARY OF THE INVENTION

Technical Problem

However, in the air conditioner described in Japanese Patent Application Laid-Open Publication No. 8-135994 (Patent Literature 1), the end portion of the heat exchanger is lifted up to form the clearance between the heat exchanger and the air conditioner main body, and the fan is drawn out through this clearance together with the bearing. If a force is exerted on a pipe for circulating a refrigerant when the end portion of the heat exchanger is lifted up, the pipe may be broken or bent. Accordingly, it is difficult to draw the fan out of the air conditioner by employing this method.

In addition, in the indoor apparatus of the air conditioner described in Japanese Patent Application Laid-Open Publication No. 10-137698 (Patent Literature 2), when the fan is attached to and detached from the indoor apparatus of the air conditioner from which the front panel and the components in front of the blow-out port, namely, the louver and the dew drip tray are detached, the shape of the heat exchanger is determined so as to avoid the collision of the fan and the housing with the heat exchanger and so as to allow the easy attachment and detachment of the fan. Even if the components in front of the blow-out port are detached, in order to widen an attachment and detachment doorway so as to allow the fan to pass through, it is required to bend a lower portion of the heat exchanger or decrease a height of the heat exchanger. The shape of the heat exchanger determined as described above may reduce performance of the heat exchanger.

In addition, in the ceiling-mounted cassette type air conditioner described in Japanese Patent Application Laid-Open Publication No. 9-273769 (Patent Literature 3), although the side panel of the lower end of the fan casing and the blow-out port frame can be integrally detached from the fan casing, it is required to separately detach a drain pan. Incidentally, in the wall-mounted type air conditioner, it is required to detach a drain pan from a fan casing when the fan is detached from the fan casing. Therefore, even if the side panel of the lower end of the fan casing and the blow-out port frame can be integrally detached from the fan casing, work for separately detaching the drain pan becomes complicated. In Japanese Patent Application Laid-Open Publication No. 9-273769 (Patent Literature 3), a wall-mounted type air conditioner is not specifically described.

Therefore, an object of the present invention is to provide a wall-mounted type air conditioner which allows attachment and detachment of a fan without depending on a shape of an heat exchanger and without moving the heat exchanger.

Solution to Problem

A wall-mounted type air conditioner according to the present invention includes: a first housing and a second housing. The first housing houses a fan. The second housing has an outlet port peripheral part forming an outlet port for blowing out air sent out by the fan and a drain pan, the second housing being attached to the first housing so as to be detachable therefrom and attachable thereto. In the first housing, an opening part for drawing the fan out of the first housing is formed. The second housing is attached to the first housing such that the outlet port faces the opening part of the first housing. The outlet port peripheral part includes an upper wall part located above the outlet port and a lower wall part located below the outlet port.

In the wall-mounted type air conditioner configured as described above, when the second housing is attached to the first housing, the opening part of the first housing is closed by the second housing. When the fan is detached from the wall-mounted type air conditioner, first, the second housing is detached from the first housing. By detaching the second housing, the outlet port peripheral part and the drain pan which form the outlet port are detached from the first housing. Since the outlet port peripheral part forms the outlet port and includes the upper wall part located above the outlet port and the lower wall part located below the outlet port, by detaching the second housing having the outlet port peripheral part from the first housing, the whole peripheral portion of the outlet port which includes the upper wall part located above the outlet port and the lower wall part located below the outlet port is detached. In addition, by detaching the second housing from the first housing, the drain pan is also detached. By detaching the second housing from the first housing, the opening part of the first housing is opened.

As described above, since by detaching the second housing, the whole peripheral portion of the outlet port, which includes the upper wall part located above the outlet port and the lower wall part located below the outlet port, and the drain pan are detached, the size of the opening part can be made sufficiently large, as compared with a case where only either one of components on a front side or a rear side of the outlet port is detached or a case where only either one of the upper wall part and the lower wall part is detached. For example, to ensure the size of the opening part, it is not required to contrive a shape of the heat exchanger. In addition, when the fan is detached, to ensure the size of the opening part, it is not required to lift up the heat exchanger. As described above, the second housing has the outlet port peripheral part, thereby opening the opening part of the first housing so as to be sufficiently large through detaching the second housing from the first housing and thus facilitating the drawing-out of the fan through the opening part.

Through the above-described configuration, the wall-mounted type air conditioner which allows attachment and detachment of the fan without depending on a shape of the heat exchanger and without moving the heat exchanger can be provided.

In the wall-mounted type air conditioner according to the present invention, it is preferable that the second housing includes an outlet port opening and closing member and a wind direction changing member. The outlet port opening and closing member is to open and close the outlet port. The wind direction changing member is to change a direction of the air sent out by the fan from the outlet port outside the first housing.

Through the above-described configuration, the outlet port opening and closing member and the wind direction changing member, located around the outlet port, can be attached to and detached from the first housing at a time. As described above, since the members located around the outlet port can be detached from the first housing at a time, it is easy to ensure a space required to detach the fan from the first housing.

It is preferable that the wall-mounted type air conditioner according to the present invention includes a heat exchanger housed in the first housing. It is preferable that the opening part of the first housing is formed in the lower portion of the first housing. It is preferable that the heat exchanger includes a first heat exchanger part and a second heat exchanger part. It is preferable that an upper edge of the first heat exchanger part and an upper edge of the second heat exchanger part are located so as to contact each other and a lower edge of the first heat exchanger part and a lower edge of the second heat exchanger part are located so as to be spaced apart. It is preferable that the fan is located so as to be sandwiched between the first heat exchanger part and the second heat exchanger part.

Through the above-described configuration, since the lower edge of the first heat exchanger part and the lower edge of the second heat exchanger part are spaced apart, it is made easy to draw the fan out of the opening part below the heat exchanger. In addition, since the upper edge of the first heat exchanger part and the upper edge of the second heat exchanger part contact each other, while a heat exchange efficiency is maintained, the wall-mounted type air conditioner can be downsized.

It is preferable that the wall-mounted type air conditioner according to the present invention includes: a motor driving the fan; and a motor fixing part. It is preferable that the motor fixing part fixes the motor in the first housing. In addition, it is preferable that the motor fixing part is configured so as to be operable to release fixing of the motor from the first housing.

Through the above-described configuration, during the work of detaching the fan, the motor having a large weight is fixed in the first housing by the motor fixing part, thereby making it possible to prevent the motor from dropping off. In addition, by releasing the fixation of the motor from the first housing, the fan can be detached together with the motor. It is allowed to detach the fan together with the motor, whereby it is not required to provide a clearance between the fan and the motor, and a width of the wall-mounted type air conditioner can be made small. Furthermore, defects in the attachment portion of the motor and the axis hardly occur.

It is preferable that the wall-mounted type air conditioner according to the present invention includes a lower portion engaging part, an upper portion fixing part, and a rotating part. The lower portion engaging part is to engage a lower portion of the second housing with the first housing. The upper portion fixing part is to fix an upper portion of the second housing in the first housing. The rotating part is to rotate the second housing with a rotational center being the lower portion of the second housing.

It is preferable that the lower portion engaging part includes a first protrusion located in the first housing and a second protrusion located in the second housing and engaged with the first protrusion. It is preferable that the rotating part includes a first rotating part component located in the first housing and a second rotating part component located in the second housing, the second rotating part component being combined with the first rotating part component and constituting the rotating part together with the first rotating part component.

After the second housing has been detached from the first housing and the fan has been cleaned, the second housing is attached to the first housing again as described below. First, by combining the first rotating part component and the second rotating part component, the rotating part is configured, thereby allowing the second housing to rotate with the rotational center being the lower portion of the second housing. Next, with the rotational center being the lower portion of the second housing, the second housing is rotated. In the lower portion of the rotated second housing, the second protrusion of the second housing is engaged in the first protrusion of the first housing. When the first protrusion and the second protrusion are engaged with each other, in the lower portion engaging part, the first housing and the lower portion of the second housing are engaged with each other. In addition, the upper portion of the rotated second housing is fixed in the first housing. The upper portion of the second housing is fixed in the first housing, for example, through screw-fastening in the upper portion fixing part.

As described above, the second housing detached from the first housing can be easily attached to the first housing again.

Advantageous Effects of the Invention

As described above, according to the present invention, a wall-mounted type air conditioner which allows attachment and detachment of a fan without depending on a shape of a heat exchanger and without moving the heat exchanger can be provided.

DESCRIPTION OF EMBODIMENTS

Hereinafter, an embodiment of the present invention will be described with reference to the accompanying drawings.

Figure 1:
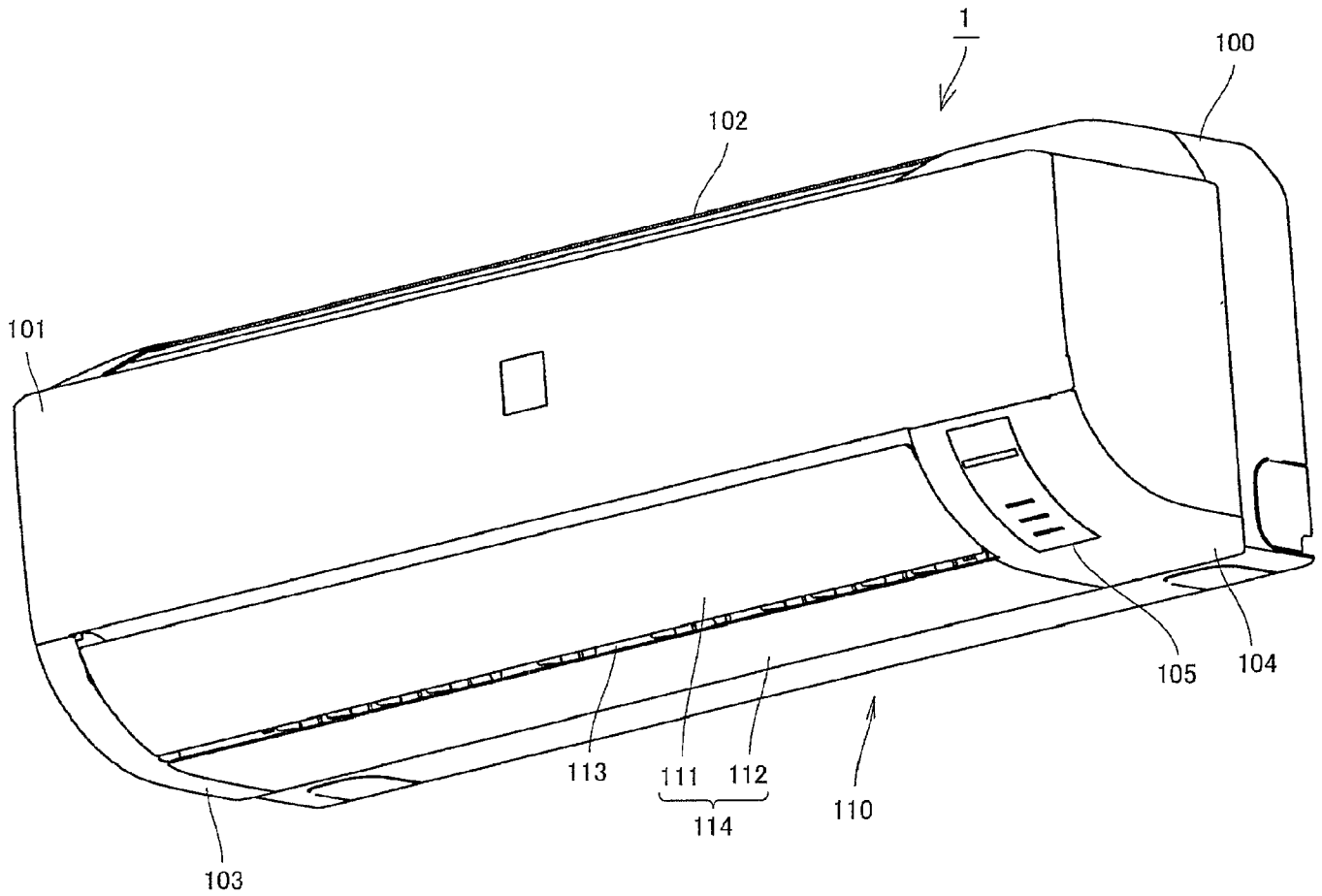
FIG. 1 is a perspective view showing the whole of a wall-mounted type air conditioner according to one embodiment of the present invention.

As shown in FIG. 1, the whole of a wall-mounted type air conditioner 1 according to one embodiment of the present invention is covered by a main body 100 as a first housing and a drain pan assembly 110 as a second housing. The main body 100 includes: an open panel 101, a grill 102, a left cover 103, and a right cover 104. In the wall-mounted type air conditioner 1, it is defined that a side on which the open panel 101 is located is a front side (forward side), a side on which the left cover 103 is located is a left side, and a side on which the right cover 104 is located is a right side.

The open panel 101 covers the front side of the wall-mounted type air conditioner 1. The grill 102 covers an upper surface of the wall-mounted type air conditioner 1. In the grill 102, a plurality of inlet ports (not shown) are formed. The left cover 103 covers a lower portion of the open panel 101 on the left side of the wall-mounted type air conditioner 1. The right cover 104 covers a lower portion of the open panel 101 on the right side of the wall-mounted type air conditioner 1. In the right cover 104, a display part 105 is arranged. On the display part 105, an operation state, a wind direction, an air volume, a set temperature, a temperature of a room targeted for air conditioning, and the like are displayed.

A lower portion of the open panel 101 on the front side of the wall-mounted type air conditioner 1 is covered by the drain pan assembly 110. In the drain pan assembly 110, a lateral louver (horizontal louver) 111 and an outlet port rear projecting part 112 are attached. The lateral louver 111 is one example of an outlet port opening and closing member and also serves as a wind direction changing member. In the drain pan assembly 110, as described later, a drain pan and an ion generator as an ion supplying member are attached.

Between the lateral louver 111 and the outlet port rear projecting part 112 of the drain pan assembly 110, an outlet port 113 is formed. Above the outlet port 113, an upper wall part 118 is arranged. In FIG. 1, a front surface of the upper wall part 118 is covered by the lateral louver 111. Below the outlet port 113, the outlet port rear projecting part 112 as a lower wall part is located. The outlet port 113 is an opening formed between the upper wall part 118 and the outlet port rear projecting part 112. The lateral louver 111 is attached in the drain pan assembly 110 so as be operable to move in a rotating manner and to open or close the outlet port 113. The outlet port rear projecting part 112 is fixed in the drain pan assembly 110 so as not to move in a rotating manner. In FIG. 1, a state where the lateral louver 111 closes the outlet port 113 is shown. The lateral louver 111, the upper wall part 118, and the outlet port rear projecting part 112 constitute an outlet port peripheral part 114.

Figure 2:
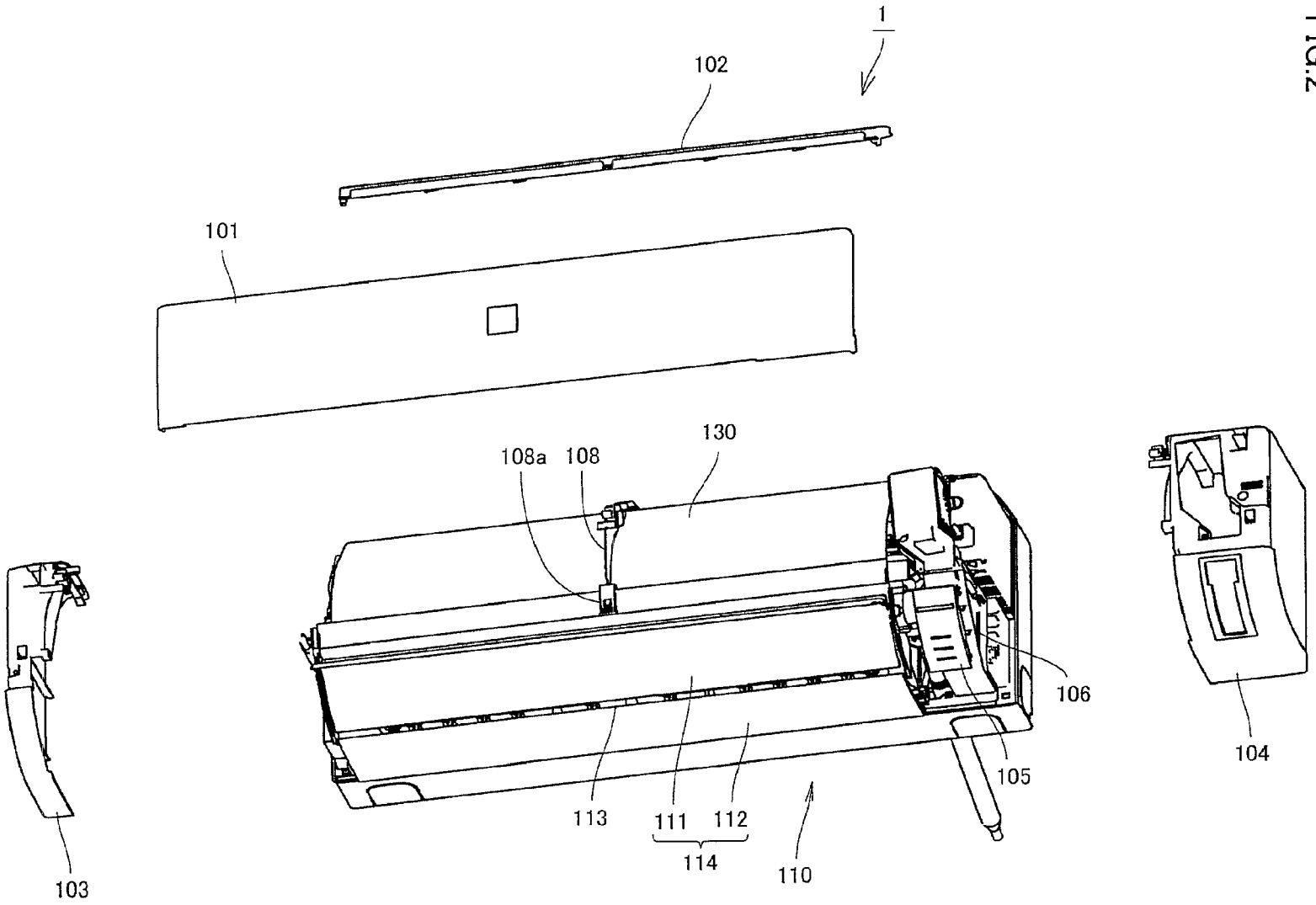
FIG. 2 is a diagram illustrating a state where parts of a main body of the wall-mounted type air conditioner according to the one embodiment of the present invention are detached and detached members which constitute the main body.

As shown in FIG. 2, the open panel 101, the grill 102, the left cover 103, and the right cover 104 of the main body 100 can be each detached from the wall-mounted type air conditioner 1. On an inner side of the open panel 101, a heat exchanger 130 is located. On the inner side of the right cover 104, an electric component box 106 is located on a rear side of the display part 105. In the electric component box 106, a controller and the like are housed.

In front of the heat exchanger 130, a central filter guide 108 for supporting a filter is attached. At a lower end portion of the central filter guide 108, a temporary fastening part 108*a* is formed. The temporary fastening part 108*a* nips and presses a central portion of an upper end of the drain pan assembly 110 from a front side toward a rear side of the main body 100.

Figure 3:
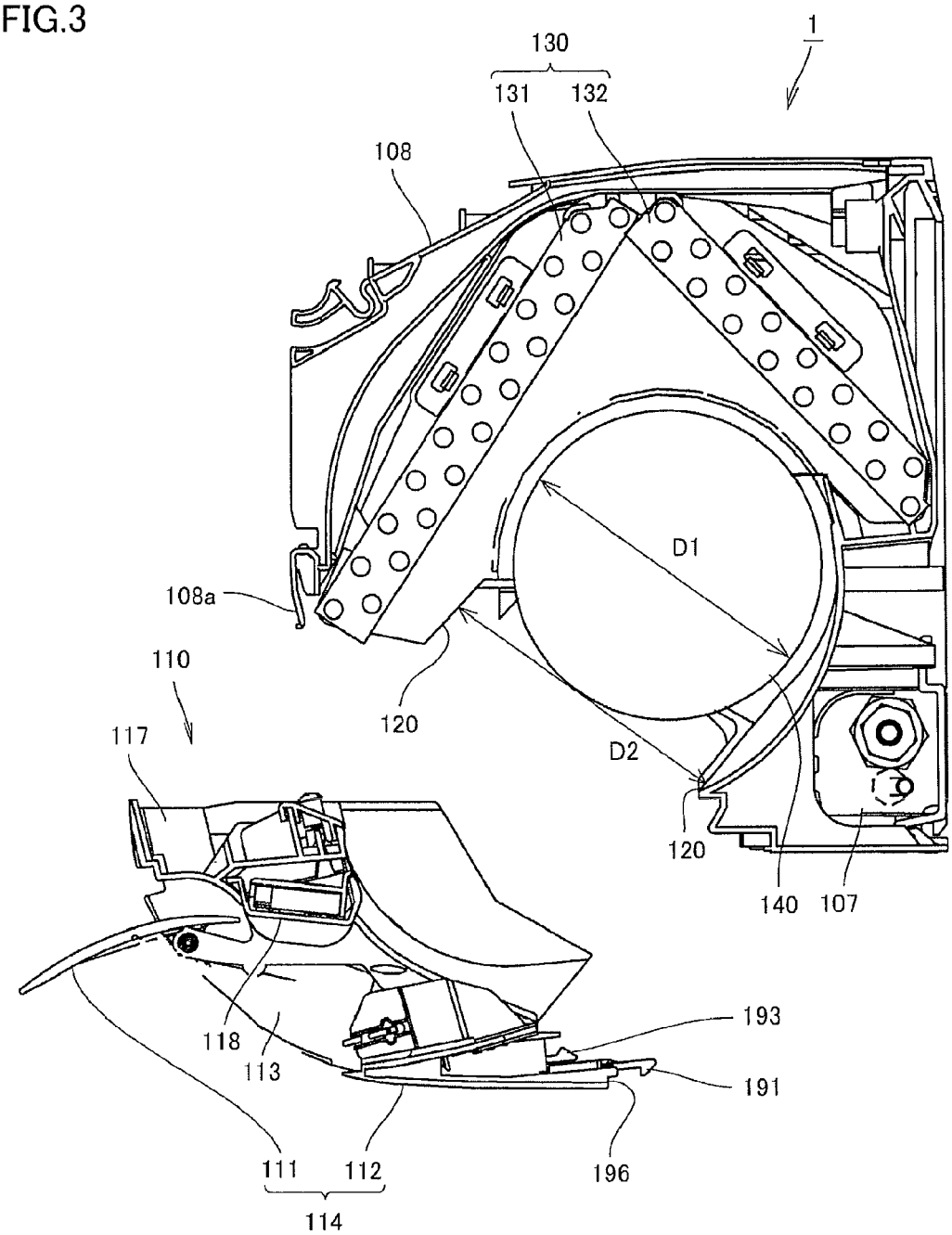
FIG. 3 is a cross-sectional view showing a state where a drain pan assembly is detached from the wall-mounted type air conditioner according to the one embodiment of the present invention.

As shown in FIG. 3, the drain pan assembly 110 can be detached from the wall-mounted type air conditioner 1. FIG. 3 is a diagram illustrating a cross section, in a horizontal direction, of a central portion of the wall-mounted type air conditioner 1. When the drain pan assembly 110 is detached from the main body 100 of the wall-mounted type air conditioner 1, the lateral louver 111, the outlet port rear projecting part 112, and the upper wall part 118 in which a drain pan 117 as a drip sink is located are detached from the main body 100. As described above, when the drain pan assembly 110 is detached from the main body 100, the whole of the outlet port peripheral part 114 which the lateral louver 111, the upper wall part 118, and the outlet port rear projecting part 112 constitute and the drain pan 117 are detached from the main body 100.

By detaching the drain pan assembly 110 from the main body 100, a lug 191 and lugs 193 formed in lower portions of the drain pan assembly 110 are detached from protrusions of the main body 100. The lugs 191 and 193 and the protrusions of the main body 100 will be described later. In addition, a recess part 196 as a second rotating part component of a rotating part is also detached from the main body 100. The recess part 196 will be also described later. In addition, a central portion of an upper edge of the drain pan assembly 110 is disengaged from the temporary fastening part 108*a*.

By detaching the drain pan assembly 110 from the main body 100, an opening part 120 formed in the main body 100 is opened. In the back of the opening part 120, a fan 140 is located. As shown in FIG. 3, the opening part 120 is formed so as to have a size which allows the fan 140 to pass through. A diameter D2 of the opening part 120 is formed so as to be larger than a diameter D1 of the fan.

A front side heat exchanger part 131 as a first heat exchanger part of the heat exchanger 130 is located so as to extend from a front surface side of the fan 140 toward an upper side thereof. A rear side heat exchanger part 132 as a second heat exchanger part of the heat exchanger 130 is located so as to extend from a rear surface side of the fan 140 toward the upper side thereof. The front side heat exchanger part 131 and the rear side heat exchanger part 132 are located so as to be spaced from the fan 140. An upper end of the front side heat exchanger part 131 and an upper end of the rear side heat exchanger part 132 contact each other. Between a lower end of the front side heat exchanger part 131 and a lower end of the rear side heat exchanger part 132, the fan 140 is located and the lower end of the front side heat exchanger part 131 and the lower end of the rear side heat exchanger part 132 are spaced from each other.

Behind the fan 140 and in a lower portion inside the main body 100, a piping container part 107 for housing pipes such as a drain pipe is located.

When being attached to the main body 100, the drain pan assembly 110 causes the opening part 120 to be in a closed state. On the other hand, when the drain pan assembly 110 is detached therefrom, the opening part 120 which is caused to be in the closed state by the drain pan assembly 110 is opened. In the drain pan assembly 110, not only the lateral louver 111 located on the front side of the outlet port 113 but also the upper wall part 118 located above the outlet port 113 and the outlet port rear projecting part 112 on a rear side of the outlet port 113 and below the outlet port 113 are attached. Therefore, by detaching the drain pan assembly 110 from the main body 100, not only in an region of either of the lateral louver 111 located on the front side of the outlet port 113, the upper wall part 118, or the outlet port rear projecting part 112 located on the rear side of the outlet port 113 but in a wide region from the front side of the outlet port 113 to the rear side thereof, the opening part 120 is opened.

Figure 4:
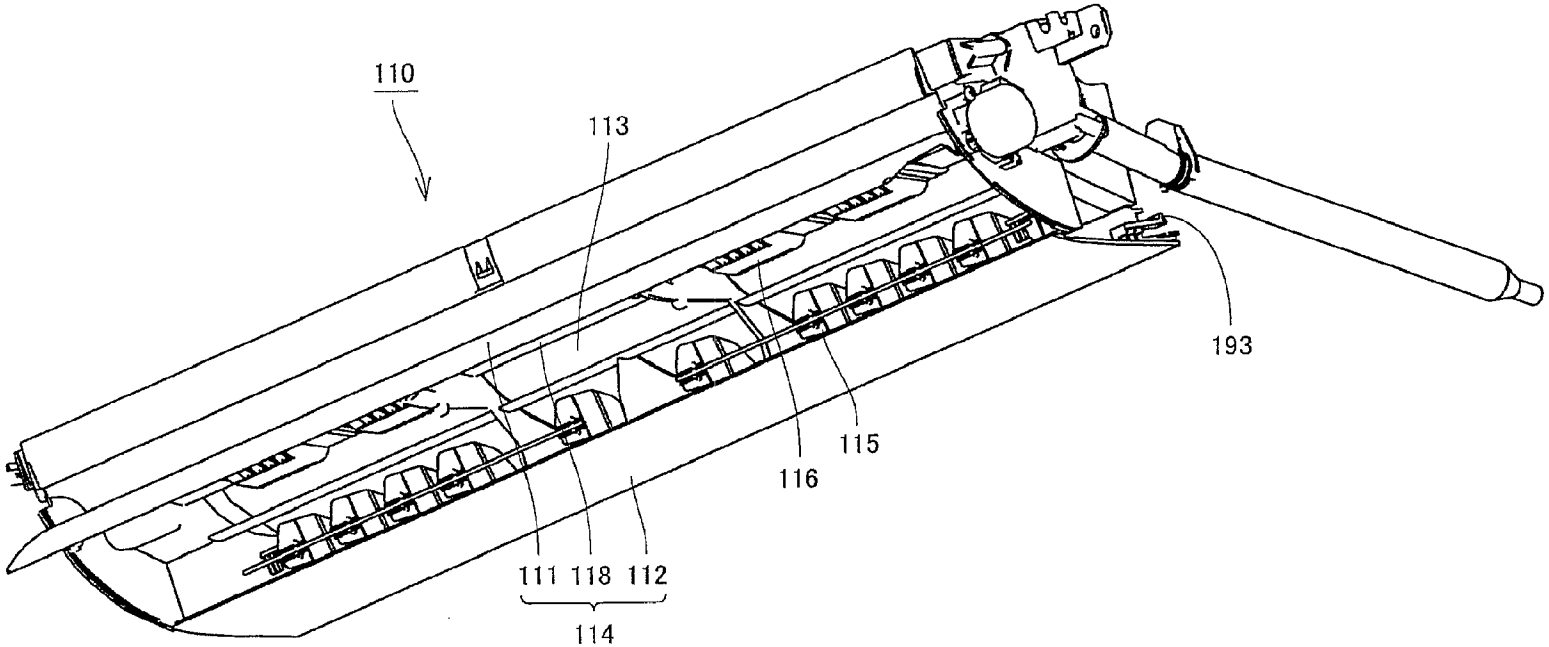
FIG. 4 is a perspective view showing the drain pan assembly detached from the wall-mounted type air conditioner according to the one embodiment of the present invention.

As shown in FIG. 4, in the drain pan assembly 110 detached from the main body 100 of the wall-mounted type air conditioner 1, the lateral louver 111, the upper wall part 118, the outlet port rear projecting part 112, a longitudinal louver (vertical louver) 115 as a wind direction changing member, and the ion generator 116 are attached. The lateral louver 111 and the longitudinal louver 115 are located around the outlet port 113 to change a direction of air sent out from the outlet port 113. The ion generator 116 is located in around the outlet port 113 to conduct sterilizing and deodorizing in a room targeted for air conditioning by supplying ions to the air sent out from the outlet port 113. In the drain pan assembly 110, other members such as an outlet port temperature sensor, an ozone generation unit, and a display part may be attached.

The lateral louver 111, the upper wall part 118, the outlet port rear projecting part 112, the longitudinal louver 115, the ion generator 116, and the like are attached in the drain pan assembly 110, thereby allowing these members to be detached from the main body 100 together with the drain pan assembly 110 when the drain pan assembly 110 is detached from the main body 100. Although in the present embodiment, the ion generator 116 is included in the drain pan assembly 110, it is not necessarily required that the ion generator 116 is included in the drain pan assembly 110.

As described above, since the members located around the outlet port 113 can be detached together with the drain pan assembly 110 from the main body 100, it is easy to ensure a size of the opening part 120 (FIG. 3), which is required to detach the fan 140 (FIG. 3).

Figure 5:
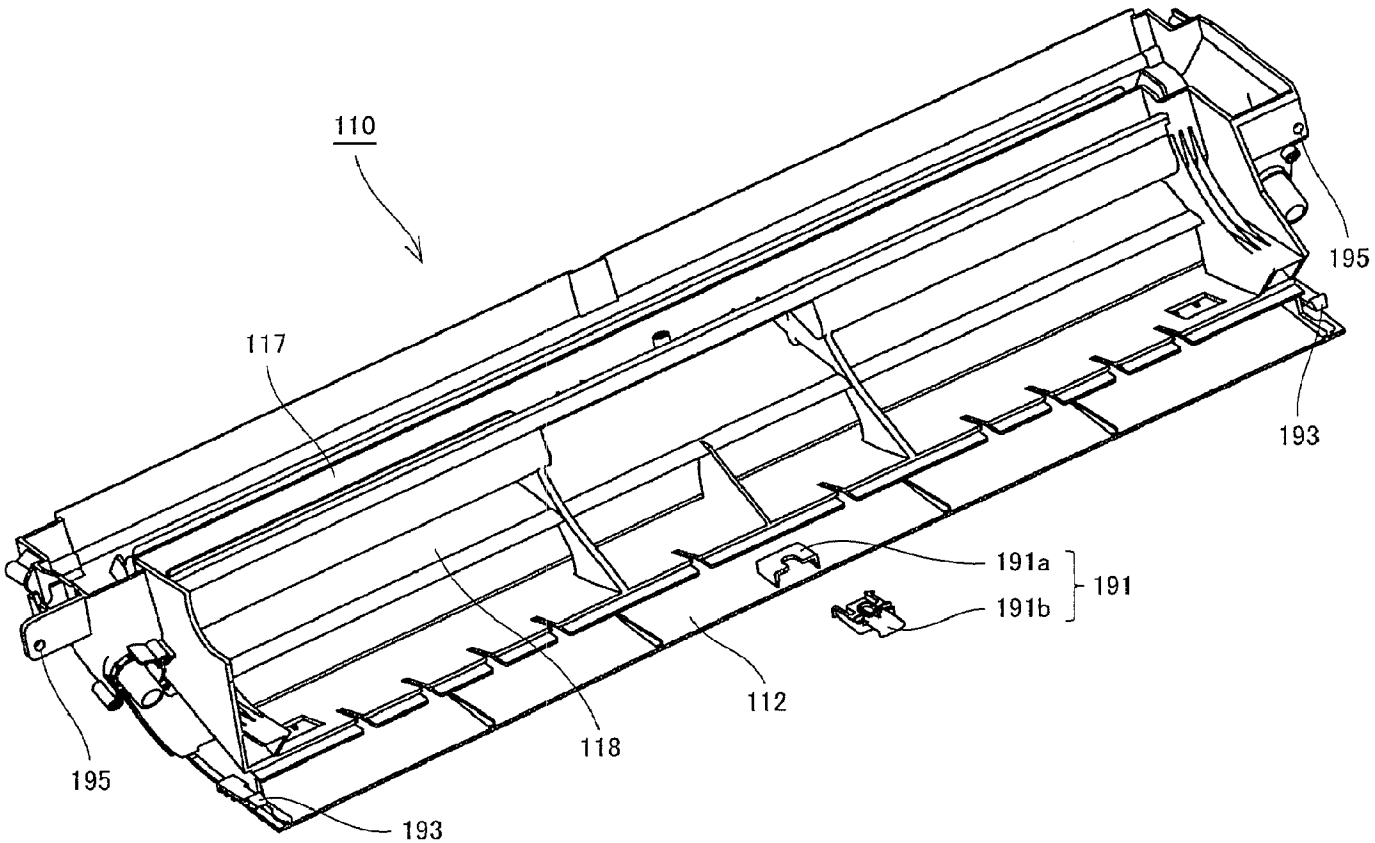
FIG. 5 is a perspective view showing an inside of the drain pan assembly of the wall-mounted type air conditioner according to the one embodiment of the present invention.

As shown in FIG. 5, in a central portion, in a horizontal direction, on an inner side of the outlet port rear projecting part 112 of the drain pan assembly 110, the lug 191 is formed as a second protrusion. A lug container part 191*a* and a lug main body 191*b* constitute the lug 191. The lug main body 191*b* is attached to and detached from the lug container part 191*a*. The lug container part 191*a* and the lug main body 191*b* may be formed of the same material or may be formed of materials different from each other. The lug 191 is configured by the lug container part 191*a* and the lug main body 191*b*, whereby when the lug main body 191*b* is broken, it is not required to replace the whole of the drain pan assembly 110 and only the lug main body 191*b* of the lug 191 can be replaced.

On right and left lower end portions on the inner side of the outlet port rear projecting part 112 of the drain pan assembly 110, the lugs 193 are formed as second protrusions.

In addition, in right and left upper end portions of the drain pan assembly 110, screw-fastening parts 195 are formed as upper part fixing parts.

Figure 6:
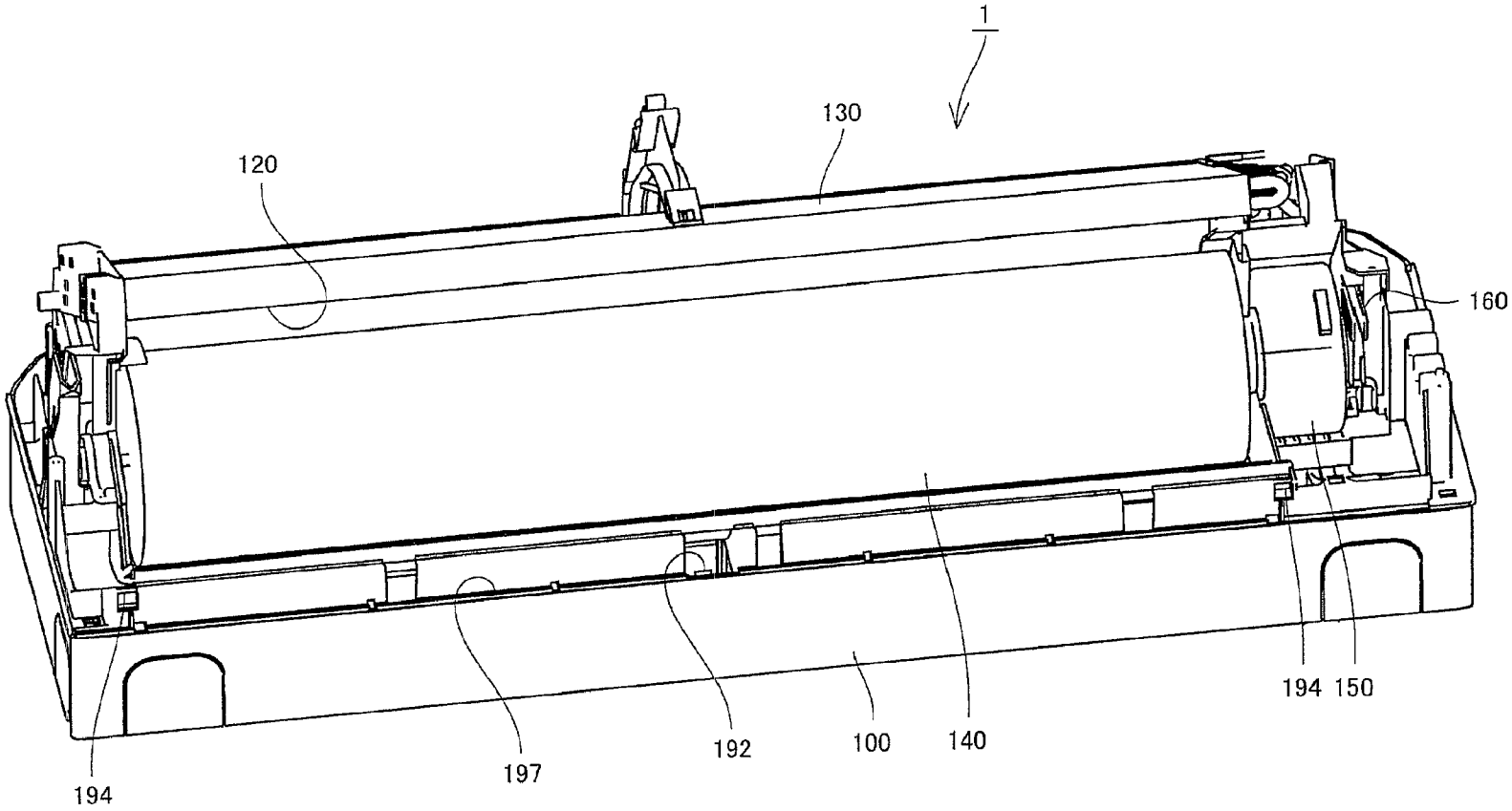
FIG. 6 is a perspective view taken when a state where a part of the main body and the drain pan assembly are detached from the wall-mounted type air conditioner according to the one embodiment of the present invention is seen from below.

As shown in FIG. 6, when a state where the left cover 103, the right cover 104, and the drain pan assembly 110 are detached from the main body of the wall-mounted type air conditioner 1 is viewed from below, the whole of a lower surface of the fan 140 can be seen through the opening part 120. On a left side of the fan 140, as described later, a rotation axis of the fan 140 is supported by a fan bearing. On a right side of the fan 140, a motor 150, connected to the rotation axis of the fan 140, for driving the fan 140 and a motor retaining member 160 are located.

In a central portion in a horizontal direction of a lower portion of the main body 100, a protrusion 192 is formed as a first protrusion. In addition, in the lower portion of the main body 100 and in right and left lower portion of the fan 140, protrusions 194 are formed as first protrusions.

An edge 197 in the lowermost portion of the main body 100, which faces the outlet port rear projecting part 112 (FIG. 5), is one example of the first rotating part component of the rotating part. The edge 197 and the recess part 196 (FIG. 3) constitute the rotating part.

The lug 191 and the lugs 193 of the drain pan assembly 110, shown in FIG. 5, and the protrusion 192 and the protrusions 194 of the main body 100, shown in FIG. 6, constitute a lower portion engaging part. When the drain pan assembly 110 is attached to the main body 100, the lug 191 of the drain pan assembly 110 is engaged with the protrusion 192 of the main body 100. In addition, the lugs 193 of the drain pan assembly 110 are engaged with the protrusions 194 of the main body 100.

Figure 7:
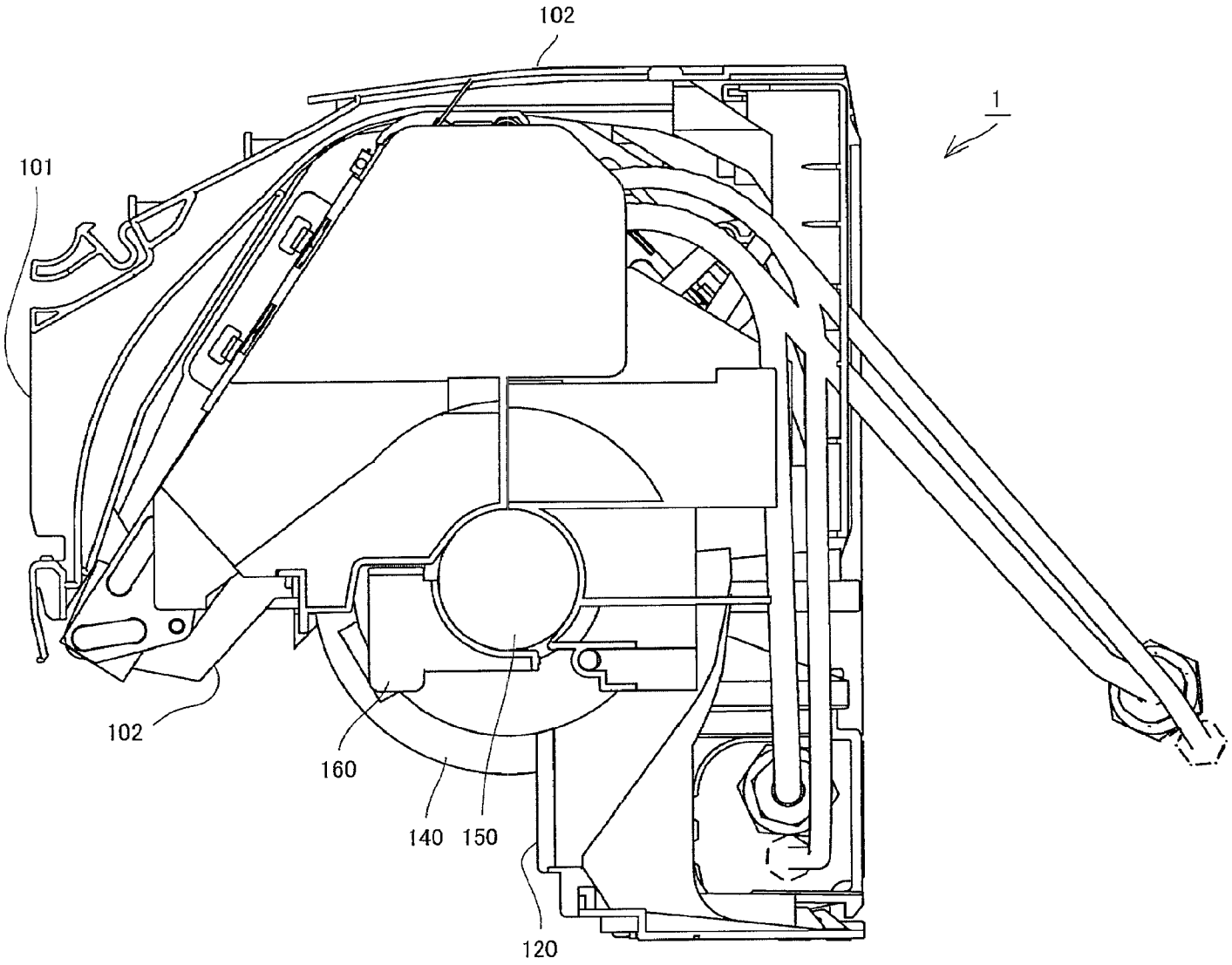
FIG. 7 is a diagram illustrating a motor and a motor retaining member of the wall-mounted type air conditioner according to the one embodiment of the present invention.

FIG. 7 is a view in which an inside of the main body 100 of the wall-mounted type air conditioner 1 is seen from a side of the motor retaining member 160. As shown in FIG. 7, the motor 150 is supported from below by the motor retaining member 160 and fixed in the main body 100. Therefore, even when the drain pan assembly 110 and the right cover 104 are detached from the main body 100, the fan 140 and the motor 150 do not drop.

Figure 8B:
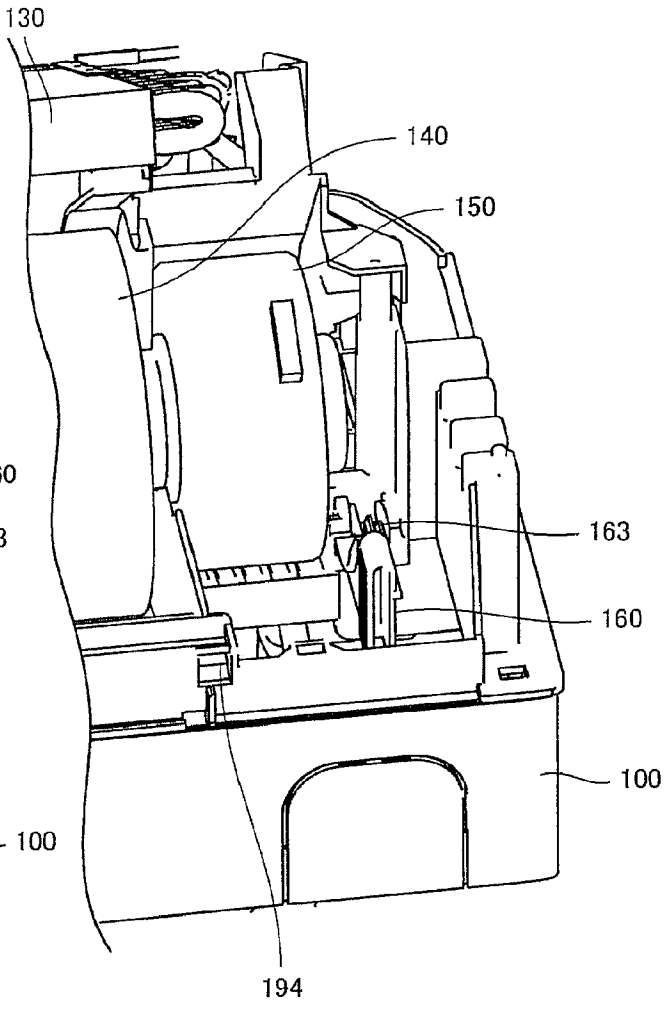
FIG. 8 shows a diagram (A) illustrating a state where the motor of the wall-mounted type air conditioner according to the one embodiment of the present invention is fixed in the main body by means of the motor retaining member and a diagram (B) illustrating a state where the motor retaining member is detached from the motor.
Figure 8A:
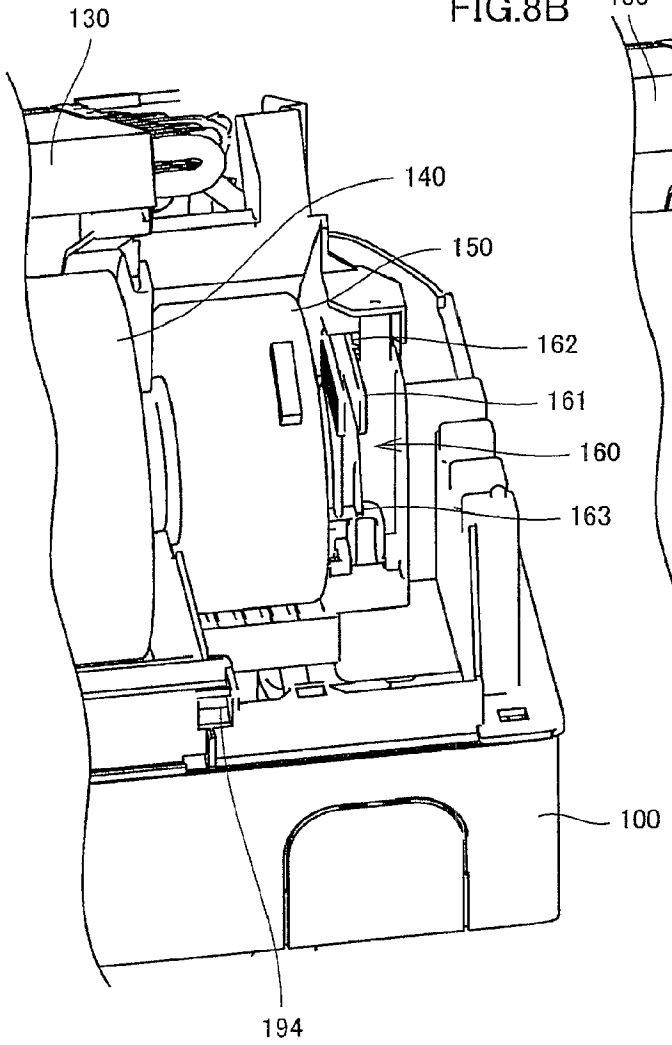

As shown in FIG. 8, to detach the fan 140 from the main body 100, fixing of the motor 150 by the motor retaining member 160 is released. As shown in FIG. 8A, when a pinch 161 of the motor retaining member 160 is nipped while the motor 150 is fixed by the motor retaining member 160, a lug 162 of the motor retaining member 160 is disengaged from the main body 100. When with the lug 162 being disengaged, the pinch 161 is nipped, the motor retaining member 160 is rotated with a rotational center being a motor retaining member rotation axis 163 so as to come to be in a state shown in FIG. 8B. When the motor retaining member 160 is rotated to be in a position shown in FIG. 8B, the motor 150 is released from the motor retaining member 160, thereby allowing the motor 150 to be detached from the main body 100. As described above, the motor retaining member 160 is a rotating-type motor fixing part.

Figure 9:
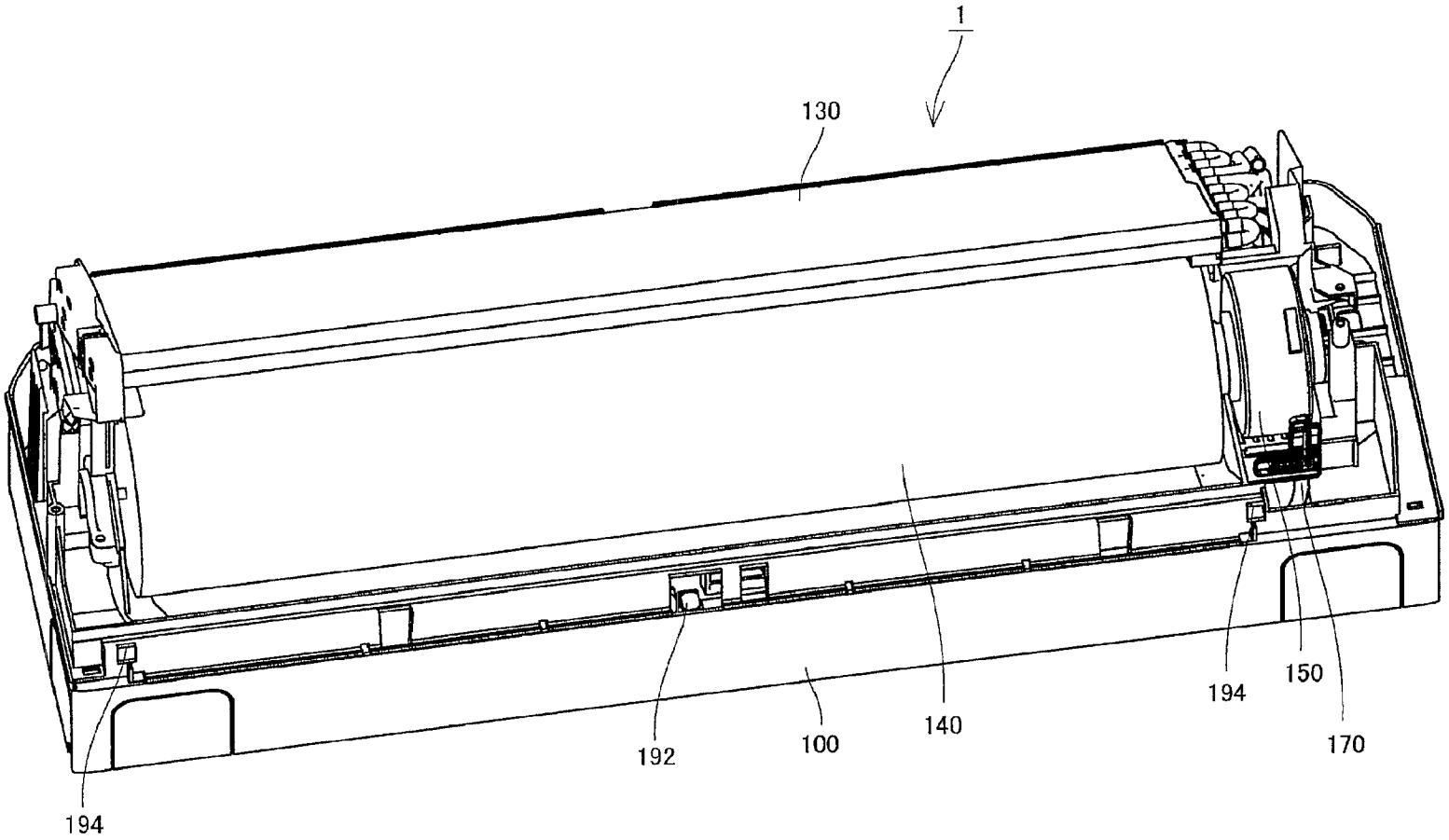
FIG. 9 is a perspective view showing the motor of the wall-mounted type air conditioner according to the one embodiment of the present invention and a motor retaining member in another form.

As shown in FIG. 9, as a motor fixing part which is different from the motor retaining member 160 (FIG. 8), a motor retaining member 170 may be used. The motor retaining member 170 supports the motor 150 from below in a right side rear portion of the motor 150.

Figures 10A, 10B:
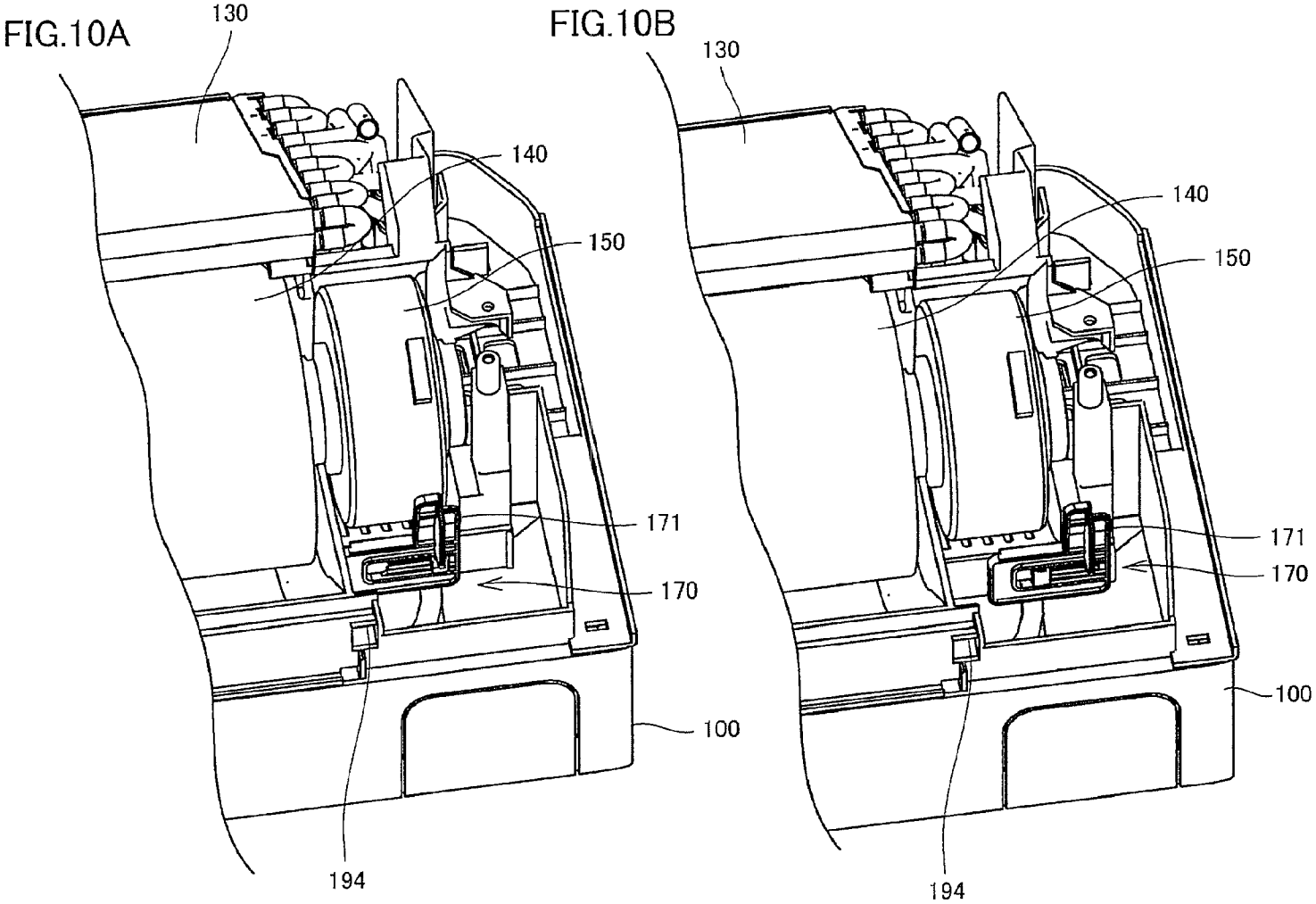
FIG. 10 shows a diagram (A) illustrating a state where the motor of the wall-mounted type air conditioner according to the one embodiment of the present invention is fixed in the main body by means of the motor retaining member in another form and a diagram (B) illustrating a state where the motor retaining member in another form is detached from the motor.

As shown in FIG. 10A, when a pinch 171 of the motor retaining member 170 is nipped and the motor retaining member 170 is slid in a right direction, as shown in FIG. 10B, the motor retaining member 170 is detached from the motor 150. As described above, the motor retaining member 170 is a sliding-type motor fixing part.

By using the rotating-type motor retaining member 160 or the sliding-type motor retaining member 170, shown in FIG. 7 through FIG. 10, the motor 150 can be easily fixed. In addition, it is also made easy to detach the motor 150 from the main body 100.

In addition, the motor 150 may be fixed by means of screws in the main body 100. In a case where the screws are used as motor fixing parts, for example, the motor 150 is covered by a covering member from below and end portions of this covering member are, for example, fixed by means of the screws onto the main body, thereby fixing the motor 150 in the main body 100.

Figure 11:
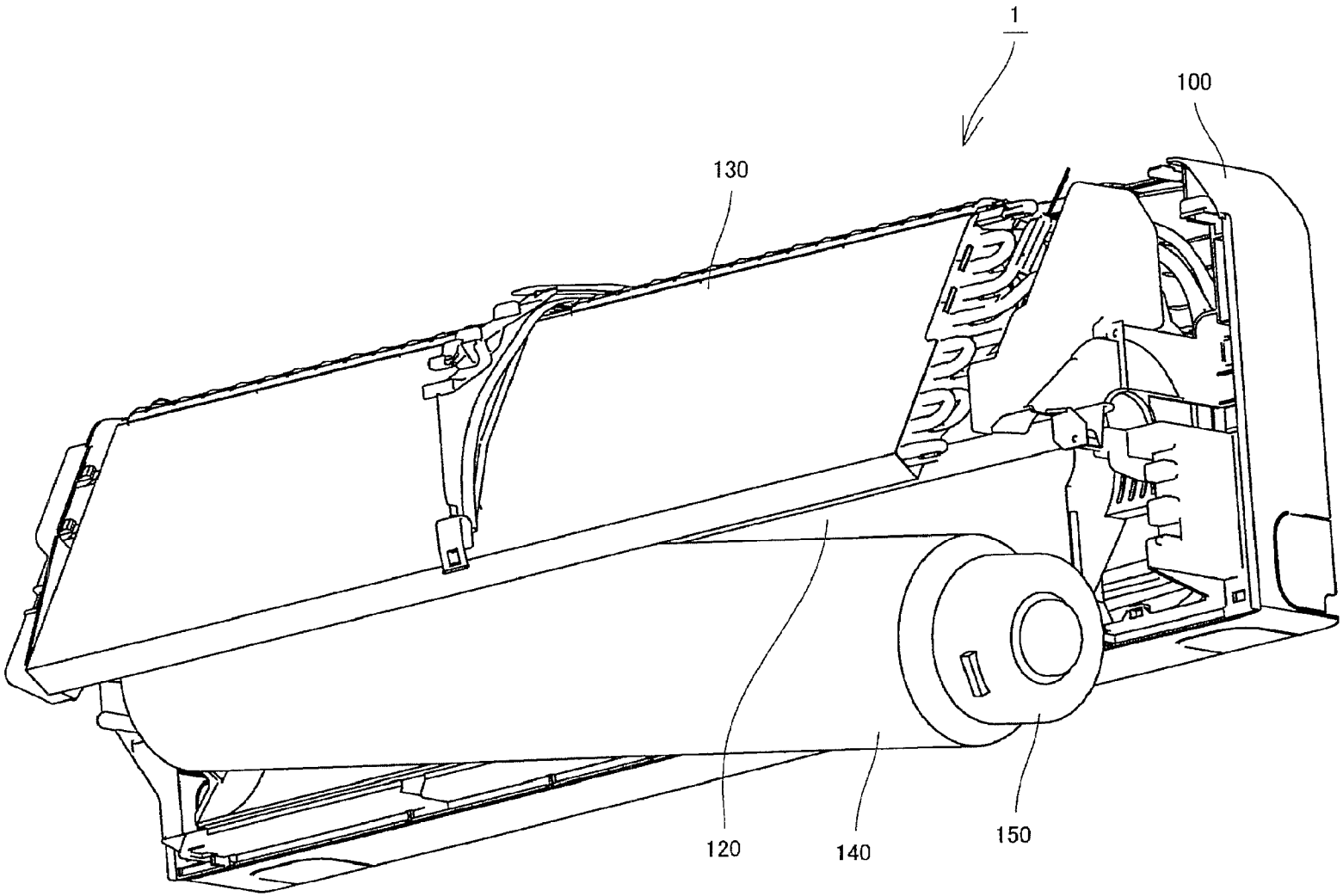
FIG. 11 is perspective view showing a process for detaching a fan and the motor of the wall-mounted type air conditioner according to the one embodiment of the present invention from the main body.

As shown in FIG. 11, when the fixing of the motor 150 is released, the right side of the fan 140 passes together with the motor 150 from below the heat exchanger 130 through the opening part 120 and is drawn out of the main body 100. On a left side end portion of the fan 140, the rotation axis of the fan 140 protrudes and in a state shown in FIG. 11, the rotation axis of the fan 140 is supported in the fan bearing.

Figure 12A:
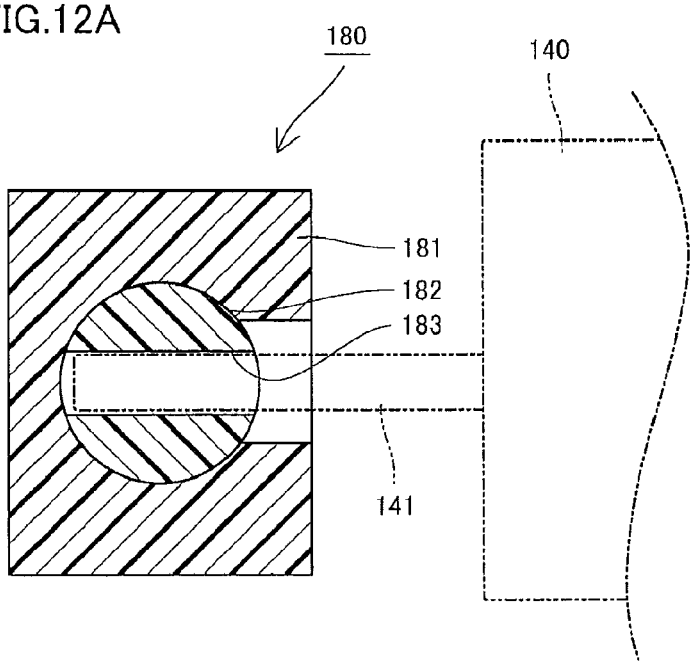
FIG. 12 is a diagram showing a fan bearing of the wall-mounted type air conditioner according to the one embodiment of the present invention.

FIG. 12 is a view in which the fan bearing 180 is seen from a front side. As shown in FIG. 12, a fan bearing housing 181 and a spherical body 182 housed inside the fan bearing housing 181 constitute the fan bearing 180. The spherical body 182 is housed so as to be rotatable inside the fan bearing housing 181. In the spherical body 182, a hole 183 which penetrates through the center of the spherical body 182 is formed. When the spherical body 182 is rotated inside the fan bearing housing 181, a direction of the hole 183 changes in accordance with the rotation of the spherical body 182.

Figure 12B:
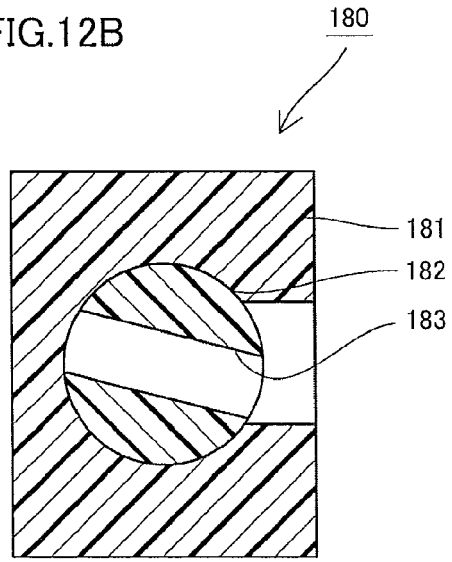

When the fan 140 is detached from the main body 100 (FIG. 11) of the wall-mounted type air conditioner 1 (FIG. 11), as described above, the fan 140 is drawn out in a right downward direction. When the fan 140 is drawn out of the main body 100 in such a manner, the rotation axis 141 of the fan 140 is also drawn in the right downward direction out of the spherical body 182 of the fan bearing housing 181. When the rotation axis 141 of the fan 140 is drawn out, as shown in FIG. 12B, the hole 183 of the spherical body 182 is inclined such that a right side thereof is lowered.

As described above, by drawing out the fan 140 toward the right downward direction, the rotation axis of the fan 140 is drawn out of the fan bearing 180, thereby allowing the fan 140 to be completely detached from the main body 100.

The fan 140 detached from the main body 100 is cleaned, thereby removing mold, water drops, dust, and the like and is made in a cleaned state. The cleaned fan 140 is attached to the main body 100 again.

When the fan 140 is attached to the main body 100 of the wall-mounted type air conditioner 1 again, the rotation axis 141 of the fan 140 is inserted into the hole 183 of the spherical body 182 of the fan bearing 180. Since the hole 183 is caused to be in the state where the right side thereof is lowered when the rotation axis 141 of the fan 140 is drawn out, by inserting the rotation axis 141 of the fan 140 from the lower right direction to an upper left direction, the rotation axis 141 is inserted into the hole 183 of the spherical body 182.

Next, the motor 150 is returned to the main body 100 and fixed by the motor fixing part such as the motor retaining member 160 or the motor retaining member 170. Thereafter, the drain pan assembly 110 is attached to the main body 100 as described below.

Figure 13:
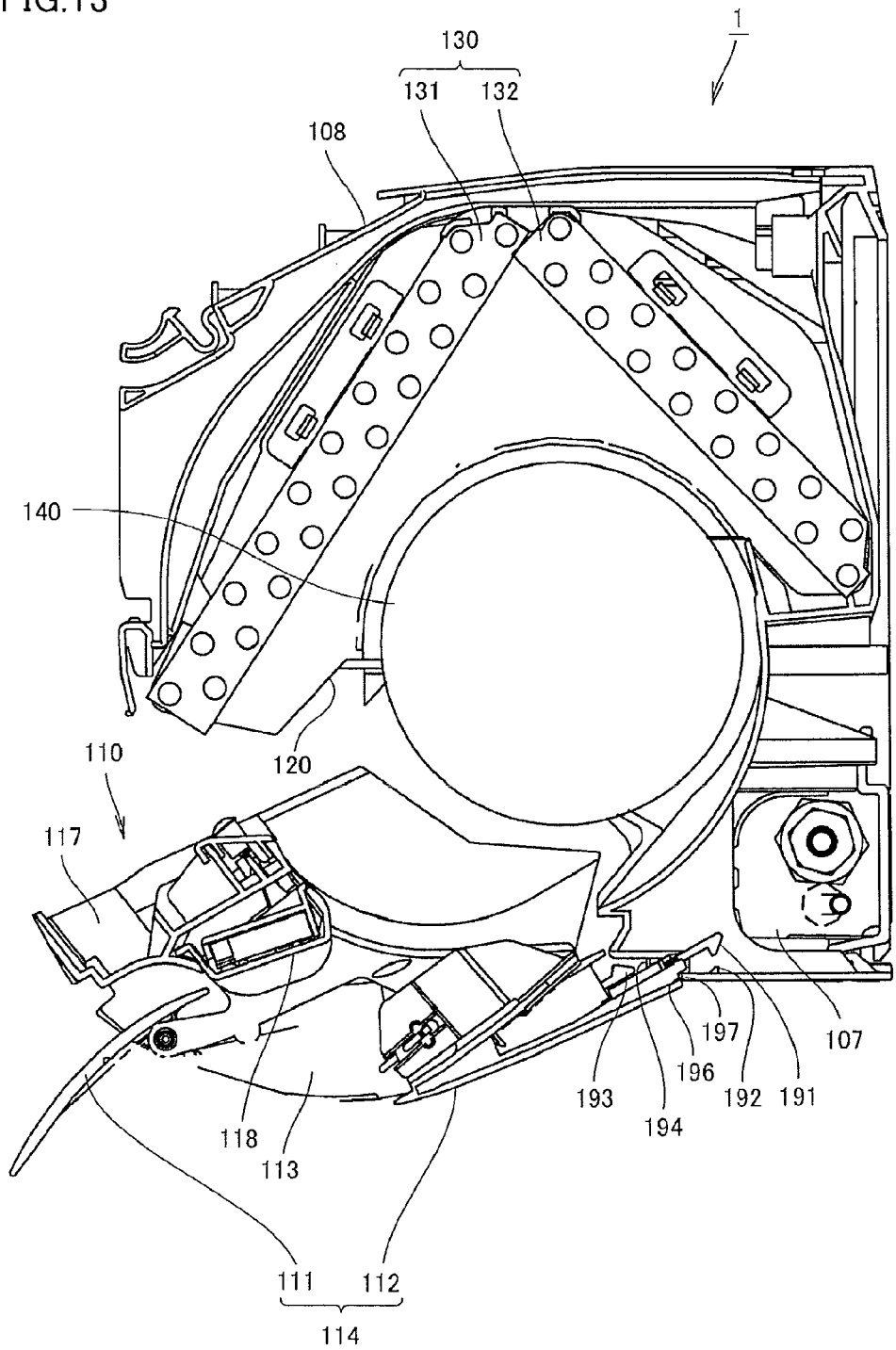
FIG. 13 is a diagram showing a process attaching a drain pan assembly of the wall-mounted type air conditioner according to the one embodiment of the present invention to the main body.

As shown in FIG. 13, when the drain pan assembly 110 is attached to the main body 100, first, a lower edge of the drain pan assembly 110 is brought into contact with a lower edge of the main body 100. At this time, the recess part 196 of the lower edge of the drain pan assembly 110 is arranged so as to be brought into contact with the edge 197 of the lower edge of the main body 100. When the recess part 196 is brought into contact with the edge 197, the edge 197 of the main body 100 is engaged into the recess part 196, and the recess part 196 and the edge 197 are combined, thereby constituting the rotating part.

Figure 14:
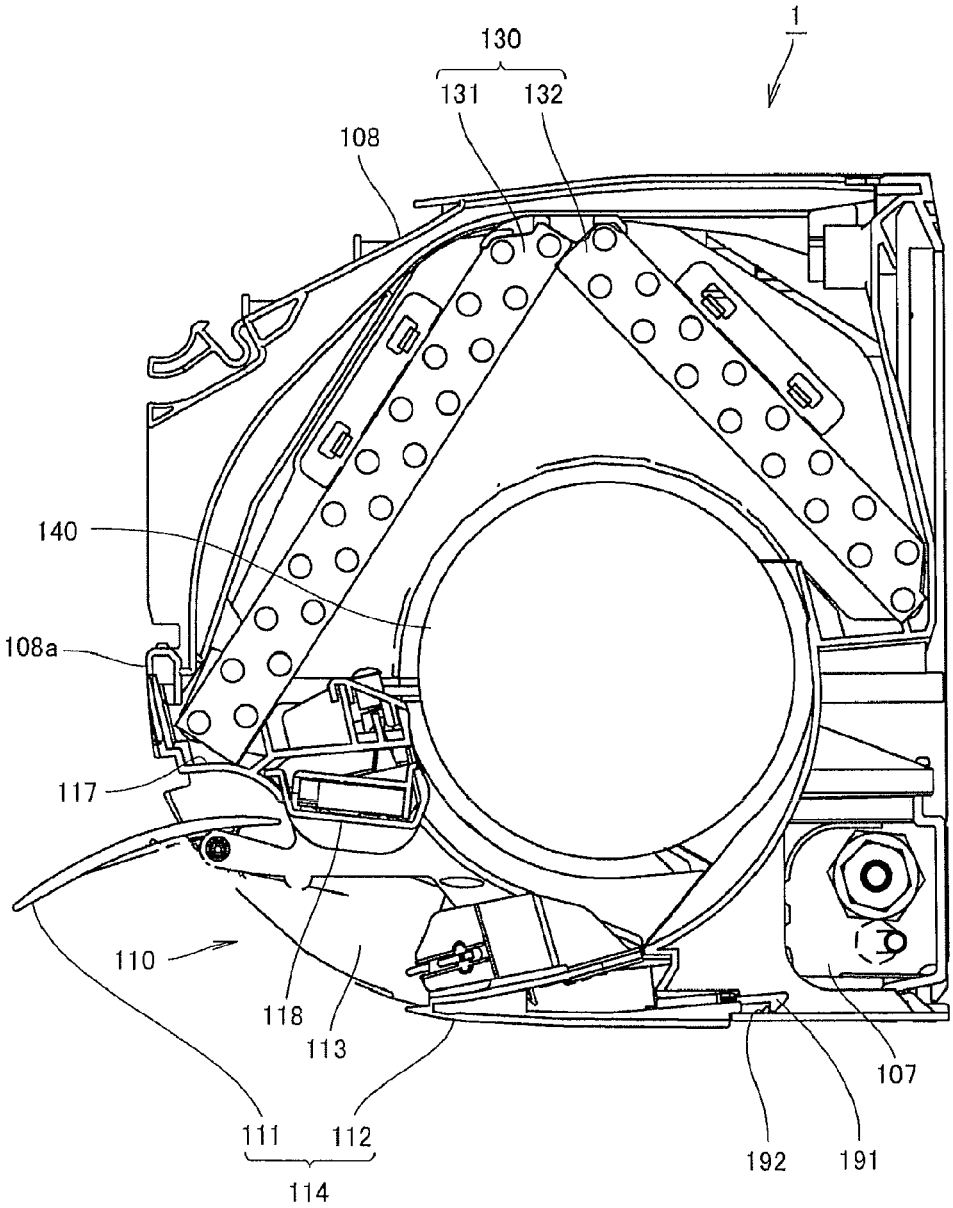
FIG. 14 is a diagram illustrating a cross section of a central portion, in a vertical direction, of the wall-mounted type air conditioner according to the one embodiment of the present invention.
Figure 15:
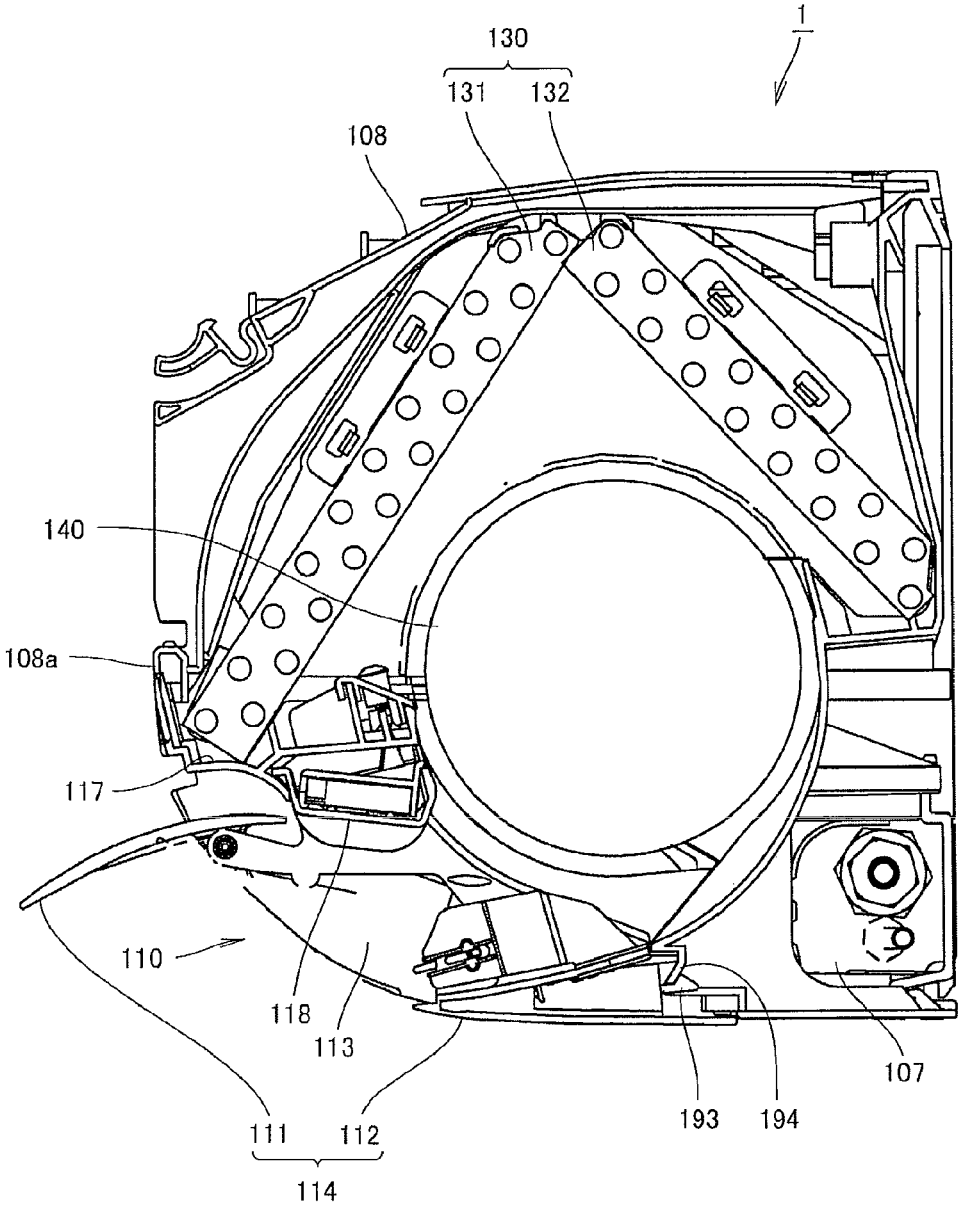
FIG. 15 is a diagram illustrating a cross section in the vicinity of an end portion, in a vertical direction, of the fan of the wall-mounted type air conditioner according to the one embodiment of the present invention.

Next, while the lower edge of the drain pan assembly 110 is caused to remain in contact with the lower edge of the main body 100, with the rotating part, which the recess part 196 and the edge 197 constitute, being caused to serve as an axis, an upper edge of the drain pan assembly 110 is rotated so as to approach the main body 100 and to close the opening part 120. When the drain pan assembly 110 is rotated in the above-mentioned manner, as shown in FIG. 14, the lug 191 located in the central portion in the horizontal direction of the drain pan assembly 110 and the protrusion 192 of the main body 100 are engaged with each other. At the same time, as shown in FIG. 15, the lugs 193 on the right and left end portions of the drain pan assembly 110 and the protrusions 194 of the main body 100 are engaged with each other.

When the drain pan assembly 110 is rotated and the drain pan assembly 110 closes the opening part 120 (FIG. 13) of the main body 100, the central portion of the upper edge of the drain pan assembly 110 is fastened onto the main body 100 by the temporary fastening part 108*a*. In addition, the screw-fastening parts 195 (FIG. 5) of the drain pan assembly 110 are located on the main body 100. The upper portion of the drain pan assembly 110 is fixed at the screw-fastening parts 195 by screws in the main body 100.

While the upper portion of the drain pan assembly 110 is fixed in the main body 100, the lower portion of the drain pan assembly 110 is engaged with the main body 100, and the central portion of the upper edge of the drain pan assembly 110 is fastened on the main body 100 by the temporary fastening part 108*a*. Therefore, even without supporting the drain pan assembly 110 with hands of a worker, it can be prevented that the drain pan assembly 110 drops from the main body 100 and that the drain pan assembly 110 and the main body 100 are misaligned in a positional relationship.

After the drain pan assembly 110 has been attached to the main body 100 as mentioned above, the left cover 103 and the right cover 104 are attached to the main body 100. As described above, the wall-mounted type air conditioner 1 is returned to the original state.

As described above, the wall-mounted type air conditioner 1 includes the main body 100 and the drain pan assembly 110. The main body 100 houses the fan 140. The drain pan assembly 110 has the outlet port peripheral part 114, forming the outlet port 113 for blowing out the air sent out by the fan 140, and the drain pan 117 and is attached to the main body 100 so as to be attachable thereto and detachable therefrom. In the main body 100, the opening part 120 for drawing the fan 140 out of the main body 100 is formed. The drain pan assembly 110 is attached to the main body 100 such that the outlet port 113 faces the opening part 120 of the main body 100. The outlet port peripheral part 114 includes the upper wall part 118 located above the outlet port 113 and the outlet port rear projecting part 112 located below the outlet port.

In the wall-mounted type air conditioner 1 configured as described above, when the drain pan assembly 110 is attached to the main body 100, the opening part 120 of the main body 100 is closed by the drain pan assembly 110. When the fan 140 is detached from the wall-mounted type air conditioner 1, first, the drain pan assembly 110 is detached from the main body 100. By detaching the drain pan assembly 110, the outlet port peripheral part 114, which forms the outlet port 113, and the drain pan 117 are detached from the main body 100. Since the outlet port peripheral part 114 forms the outlet port 113 and includes the upper wall part 118 located above the outlet port 113 and the outlet port rear projecting part 112 located below the outlet port 113, by detaching the drain pan assembly 110 having the outlet port peripheral part 114 from the main body 100, the whole peripheral portion of the outlet port 113 which includes the upper wall part 118 located above the outlet port 113 and the outlet port rear projecting part 112 located below the outlet port 113 is detached. In addition, by detaching the drain pan assembly 110 from the main body 100, the drain pan 117 is also detached. By detaching the drain pan assembly 110 from the main body 100, the opening part 120 of the main body 100 is opened.

As described above, since by detaching the drain pan assembly 110 which includes the upper wall part 118 located above the outlet port 113 and the outlet port rear projecting part 112 located below the outlet port 113, the whole peripheral portion of the outlet port 113 and the drain pan 117 are detached, the size of the opening part 120 can be made sufficiently large, as compared with a case where only either one of the assembly, which is composed of the lateral louver 111 located on the front side of the outlet port 113 and the drain pan, or the outlet port rear projecting part 112 is detached. For example, to ensure the size of the opening part 120, it is not required to make a height of the heat exchanger 130 low. The height of the heat exchanger 130 is sufficiently made high, thereby allowing a heat exchange efficiency to be maintained high, as compared with a case where the height of the heat exchanger 130 is made low. In addition, it is not required to contrive the shape of the heat exchanger 130. In addition, when the fan 140 is detached, to ensure the size of the opening part 120, it is not required to lift up the heat exchanger 130. As described above, the drain pan assembly 110 has the outlet port peripheral part 114, thereby opening the opening part 120 of the main body 100 so as to be sufficiently large through detaching the drain pan assembly 110 from the main body 100 and thus facilitating the drawing-out of the fan 140 through the opening part 120.

Through the above-described configuration, the wall-mounted type air conditioner 1 which allows attachment and detachment of the fan 140 without depending on the shape of the heat exchanger 130 and without moving the heat exchanger 130 can be provided.

In the wall-mounted type air conditioner 1, the drain pan assembly 110 includes the lateral louver 111 and the longitudinal louver 115. The lateral louver 111 opens or closes the outlet port 113. The lateral louver 111 and the longitudinal louver 115 change a direction of the air sent out by the fan 140 from the outlet port 113 outside the main body 100.

Through the above-described configuration, the lateral louver 111 and the longitudinal louver 115 located around the outlet port 113 can be attached to and detached from the main body 100 at a time. As described above, since the members located around the outlet port 113 can be detached from the main body 100 at a time, it is easy to ensure a space required to detach the fan 140 from the main body 100.

The wall-mounted type air conditioner 1 includes the heat exchanger 130 housed in the main body 100. The opening part 120 of the main body 100 is formed in the lower portion of the main body 100. The heat exchanger 130 is composed of the front side heat exchanger part 131 and the rear side heat exchanger part 132. The upper edge of the front side heat exchanger part 131 and the upper edge of the rear side heat exchanger part 132 are located so as to contact each other, and the lower edge of the front side heat exchanger part 131 and the lower edge of the rear side heat exchanger part 132 are located so as to be spaced apart. The fan 140 is located so as to be sandwiched between the front side heat exchanger part 131 and the rear side heat exchanger part 132.

Through the above-described configuration, since the lower edge of the first heat exchanger part and the lower edge of the second heat exchanger part are spaced apart, it is made easy to draw the fan 140 out of the opening part 120 below the heat exchanger 130. In addition, since the upper edge of the front side heat exchanger part 131 and the upper edge of the rear side heat exchanger part 132 contact each other, while the heat exchange efficiency is maintained, the wall-mounted type air conditioner 1 can be downsized.

In addition, the wall-mounted type air conditioner 1 includes the motor 150 for driving the fan 140 and the motor retaining member 160 or the motor retaining member 170. The motor retaining member 160 or 170 fixes the motor 150 in the upper portion of the main body 100. In addition, the motor retaining member 160 or 170 is configured so as to be operable to release the fixation of the motor 150 from the main body 100.

Through the above-described configuration, during the work of detaching the fan 140, the motor 150 having a large weight is fixed in the main body 100 by the motor retaining member 160 or the motor retaining member 170, thereby making it possible to prevent the motor 150 from dropping off. In addition, by releasing the fixation of the motor 150 from the main body 100, the fan 140 can be detached together with the motor 150. It is allowed to detach the fan 140 together with the motor 150, whereby it is not required to provide a clearance between the fan 140 and the motor 150 and a width of the wall-mounted type air conditioner 1 can be made small. Furthermore, defects in the attachment portion of the motor 150 and the axis hardly occur.

In addition, the wall-mounted type air conditioner 1 includes the lower portion engaging part, the screw-fastening parts 195, and the rotating part. The lower portion engaging part is to engage the lower portion of the drain pan assembly 110 in the main body 100. The screw-fastening parts 195 are to fix the upper portion of the drain pan assembly 110 in the main body 100. The rotating part is to rotate the drain pan assembly 110, with the rotational center being the lower portion of the drain pan assembly 110.

The lower portion engaging part includes the protrusions 192 and 194 located in the main body 100 and the lugs 191 and 193 located in the drain pan assembly 110 and engaged with the protrusions 192 and 194. The rotating part includes: the edge 197 located in the main body 100; and the recess part 196 located in the drain pan assembly 110 and combined with the edge 197, thereby constituting the rotating part.

After the drain pan assembly 110 has been detached from the main body 100 and the fan 140 has been cleaned, the drain pan assembly 110 is attached to the main body 100 again as described below. First, by combining the edge 197 and the recess part 196, the rotating part is configured, thereby allowing the drain pan assembly 110 to rotate with the rotational center being the lower portion of the drain pan assembly 110. Next, with the rotational center being the lower portion of the drain pan assembly 110, the drain pan assembly 110 is rotated. In the lower portion of the rotated drain pan assembly 110, the lugs 191 and 193 of the drain pan assembly 110 are engaged in the protrusions 192 and 194 of the main body 100. When the protrusions 192 and 194 and the lugs 191 and 193 are engaged with each other, in the lower portion engaging part, the main body 100 and the lower portion of the drain pan assembly 110 are engaged with each other, thereby allowing the drain pan assembly 110 to rotate with the rotational center being the lower portion of the drain pan assembly 110. Next, the drain pan assembly 110 is rotated with the rotational center being the lower portion of the drain pan assembly 110. In addition, the upper portion of the rotated drain pan assembly 110 is fixed in the main body 100. The upper portion of the drain pan assembly 110 is screw-fastened at the screw-fastening parts 195 and is thereby fixed in the main body 100.

As described above, the drain pan assembly 110 detached from the main body 100 can be easily attached to the main body 100 again.

In the wall-mounted type air conditioner 1, since during the work of screw-fastening the upper portion of the drain pan assembly 110 at the screw-fastening parts 195, the upper portion of the drain pan assembly 110 is supported in the main body 100 at the temporary fastening part **108*a*, even without supporting the drain pan assembly 110 with hands of a worker, it can be prevented that the drain pan assembly 110 drops from the main body 100 and that the drain pan assembly 110 and the main body 100** are misaligned in the positional relationship.

If the temporary fastening part **108*a* of the main body 100 is not provided, during the work of screw-fastening the upper portion of the drain pan assembly 110 at the screw-fastening parts 195, in order to prevent the drain pan assembly 110 from coming off and dropping off from the main body 100, it is required that a worker supports the drain pan assembly 110 with his or her hands. However, for example, by configuration the protrusions 192 and 194 and the lugs 191 and 193 of the lower portion engaging part so as to be capable of fixedly securing the drain pan assembly 110 in the main body 100 and to thereby allow the drain pan assembly 110 to be prevented from dropping off from the main body 100 even without supporting the drain pan assembly 110 with hands of a worker, even if the temporary fastening part 108*a* is not provided, the dropping-off of the drain pan assembly 110** can be prevented.

In addition, in the wall-mounted type air conditioner 1, the upper portion of the drain pan assembly 110 is screw-fastened at the screw-fastening parts 195 and thereby fixed in the main body 100. However, the upper portion of the drain pan assembly 110 may be fixed in the main body 100 at the upper portion fixing parts by employing a method other than the screw-fastening. For example, the upper portion fixing parts may also be composed of protrusions and lugs engaged with the protrusions as in the lower portion engaging part. As described above, the upper portion fixing parts are composed of the protrusions and the lugs engaged with the protrusions, thereby allowing the upper portion of the drain pan assembly 110 to be more easily fixed in the main body 100 than the screw-fastening.

The described embodiment is to be considered in all respects only as illustrative and not restrictive. It is intended that the scope of the invention is, therefore, indicated by the appended claims rather than the foregoing description of the embodiment and that all modifications and variations coming within the meaning and equivalency range of the appended claims are embraced within their scope.

REFERENCE SIGNS LIST

1: wall-mounted type air conditioner, 100: main body, 110: drain pan assembly, 111: lateral louver, 112: outlet port rear projecting part, 113: outlet port, 114: outlet port peripheral part, 115: longitudinal louver, 117: drain pan, 118: upper wall part, 120: opening part, 130: heat exchanger, 131: front side heat exchanger part, 132: rear side heat exchanger part, 140: fan, 150: motor, 160, 170: motor retaining member, 191: lug, 192: protrusion, 193: lug, 194: protrusion, 195: screw-fastening part, 196: recess part, 197: edge.

The invention claimed is:

1. A wall-mounted type air conditioner comprising:

a first housing housing a fan so as to cover the fan except a lower front portion of the fan;

a second housing having an outlet port peripheral part forming an outlet port for blowing out air sent out by the fan and having a drain pan, the second housing being attached to the first housing so as to be detachable from the first housing and attachable to the first housing, an opening part, formed in the first housing for drawing the fan out of the first housing, the opening part being formed so as to face the lower front portion of the fan, the second housing being attached to the first housing such that the outlet port faces the opening part of the first housing, the outlet port peripheral part including an upper wall part located above the outlet port and a lower wall part located below the outlet port;

a lower portion engaging part engaging a lower portion of the second housing with the first housing;

an upper portion fixing part fixing an upper portion of the second housing in the first housing; and a rotating part rotating the second housing with a rotational center being the lower portion of the second housing, wherein the lower portion engaging part includes a first protrusion located in the first housing and a second protrusion located in the second housing and engaged with the first protrusion, and the rotating part includes a first rotating part component located in the first housing and a second rotating part component located in the second housing, the second rotating part component being combined with the first rotating part component and constituting the rotating part together with the first rotating part component.

2. The wall-mounted type air conditioner according to claim 1, wherein the second housing includes:

an outlet port opening and closing member which opens and closes the outlet port; and a wind direction changing member which changes a direction of the air sent out by the fan from the outlet port outside the first housing.

3. The wall-mounted type air conditioner according to claim 1, comprising a heat exchanger housed in the first housing, wherein the opening part of the first housing is formed in a lower portion of the first housing, the heat exchanger includes a first heat exchanger part and a second heat exchanger part, an upper edge of the first heat exchanger part and an upper edge of the second heat exchanger part are located so as to contact each other and a lower edge of the first heat exchanger part and a lower edge of the second heat exchanger part are located so as to be spaced apart, and the fan is located so as to be sandwiched between the first heat exchanger part and the second heat exchanger part.

4. The wall-mounted type air conditioner according to claim 1, comprising:

a motor driving the fan; and a motor fixing part fixing the motor in the first housing, wherein the motor fixing part is configured so as to be operable to release fixing of the motor from the first housing.

* * * * *